US005636886A

United States Patent [19]

Jensen

[11] Patent Number: 5,636,886

[45] Date of Patent: Jun. 10, 1997

[54] HOLDER FOR PAINT POTS OR A SIMILAR CONTAINER HAVING AN EXTERNAL OR AN INTERNAL COLLAR

[75] Inventor: Jakob J. Jensen, Copenhagen, Denmark

[73] Assignee: Foreningen For Aktive Freeme Af Opfindelser (FAFO), Copenhagen, Denmark

[21] Appl. No.: 411,816

[22] PCT Filed: Aug. 5, 1994

[86] PCT No.: PCT/DK94/00299

§ 371 Date: Jun. 2, 1995

§ 102(e) Date: Jun. 2, 1995

[87] PCT Pub. No.: WO95/04664

PCT Pub. Date: Feb. 16, 1995

[30] Foreign Application Priority Data

Aug. 10, 1993 [DK] Denmark ..... 0919/93

[51] Int. Cl.[6] ..... B65D 25/28; E06C 7/14

[52] U.S. Cl. ..... 294/27.1; 248/211; 248/312.1

[58] Field of Search ..... 294/27.1, 31.1, 294/33; 220/696, 699–702, 756, 759, 768, 769; 224/253, 268; 248/210, 211, 311.2, 312.1

[56] References Cited

U.S. PATENT DOCUMENTS

| | | | |
|---|---|---|---|
| 1,437,171 | 11/1922 | Currey | 294/27.1 |
| 1,575,232 | 3/1926 | Shearer | 294/33 |
| 2,217,731 | 10/1940 | Davis | 294/27.1 |
| 2,308,805 | 1/1943 | Dahl | 248/211 |
| 2,541,390 | 2/1951 | Weigand | 248/210 |
| 2,884,216 | 4/1959 | Joecks . | |
| 2,993,672 | 7/1961 | Bower et al. . | |
| 3,155,360 | 11/1964 | Cassells | 248/312.1 X |
| 3,661,351 | 5/1972 | Olsen . | |
| 4,053,131 | 10/1977 | Francis | 248/211 |
| 5,145,226 | 9/1992 | LaFontaine . | |
| 5,305,977 | 4/1994 | Roth . | |

*Primary Examiner*—Johnny D. Cherry
*Attorney, Agent, or Firm*—Nixon & Vanderhye

[57] ABSTRACT

A holder for paint pots or a similar container having an external or an internal collar includes a carrier member and a container engagement member connected therewith. The container engagement member comprises a supporting part adapted to rest along the internal side of the container, and a catching part having a connecting portion which extends outwards from the upper edge of the supporting part in its position of use and is adapted to pass over the upper edge of the container. The end of the connecting portion is connected with a hook, which is adapted to catch below the internal collar, if any, of the container, the free end of the hook facing the supporting part. The supporting part further has a retaining strip on the side facing the hook, which strip is adapted to engage with the external collar of the container.

12 Claims, 1 Drawing Sheet

HOLDER FOR PAINT POTS OR A SIMILAR CONTAINER HAVING AN EXTERNAL OR AN INTERNAL COLLAR

BACKGROUND AND SUMMARY OF THE INVENTION

The invention relates to a holder for paint pots or a similar container having an external or an internal collar, which holder comprises a carrier member and a container engagement member connected therewith, wherein the container engagement member comprises a supporting part adapted for supporting rest on the exterior side of the container, and a catching part having a connecting portion which extends outwards from the upper part of the supporting part in its position of use and is adapted to pass over the upper edge of the container, and which, at its end, carries a hook adapted to catch below the internal collar of the container, the free end of the hook facing the supporting part.

U.S. Pat. Nos. 2,541,390, 2,993,672, and 5,145,226 describe holders of the type mentioned in the introduction above and serving as suspending hooks for, for example, paint pots having an internal collar. These holders have a carrier member formed in different ways so that they can be fastened to, for example, a rung or a platform on a ladder.

The object of the invention is to provide a holder which renders it possible for the user to use it for gripping and optionally suspending both containers having an internal collar and containers having an external collar.

This object is obtained according to the invention in that the supporting part of the holder has a retaining strip on the side facing the hook, which retaining strip is adapted to engage with the external collar of the container.

According to the invention, the retaining strip of the supporting part may be located at a level between the free end of the hook and the connecting portion, whereby the hook contributes to retaining the container in question on the retaining strip.

Especially suitably, the holder according to the invention may be formed integrally from a bent flat rod material, and the retaining strip may be a flap stamped out therefrom.

According to the invention, the retaining strip may have a depression in the side facing the connecting portion so that the external collar of the container is retained particularly securely by the retaining strip.

Furthermore, the free end of the hook may be planely cut off substantially in parallel with the adjacent side of the supporting part so that the hook substantially planely bears against the internal side of the container.

Correspondingly, the free end of the retaining strip may be planely cut off substantially in parallel with the adjacent side of the supporting part so that it planely bears against the exterior side of a container and thus especially may participate in retaining a container having an internal collar in engagement with the hook.

BRIEF DESCRIPTION OF THE DRAWING FIGURE

The invention will now be explained in further detail below with reference to the drawing, which shows a side view of a preferred embodiment of a holder according to the invention.

DESCRIPTION OF A PREFERRED EMBODIMENT

Figure 1:
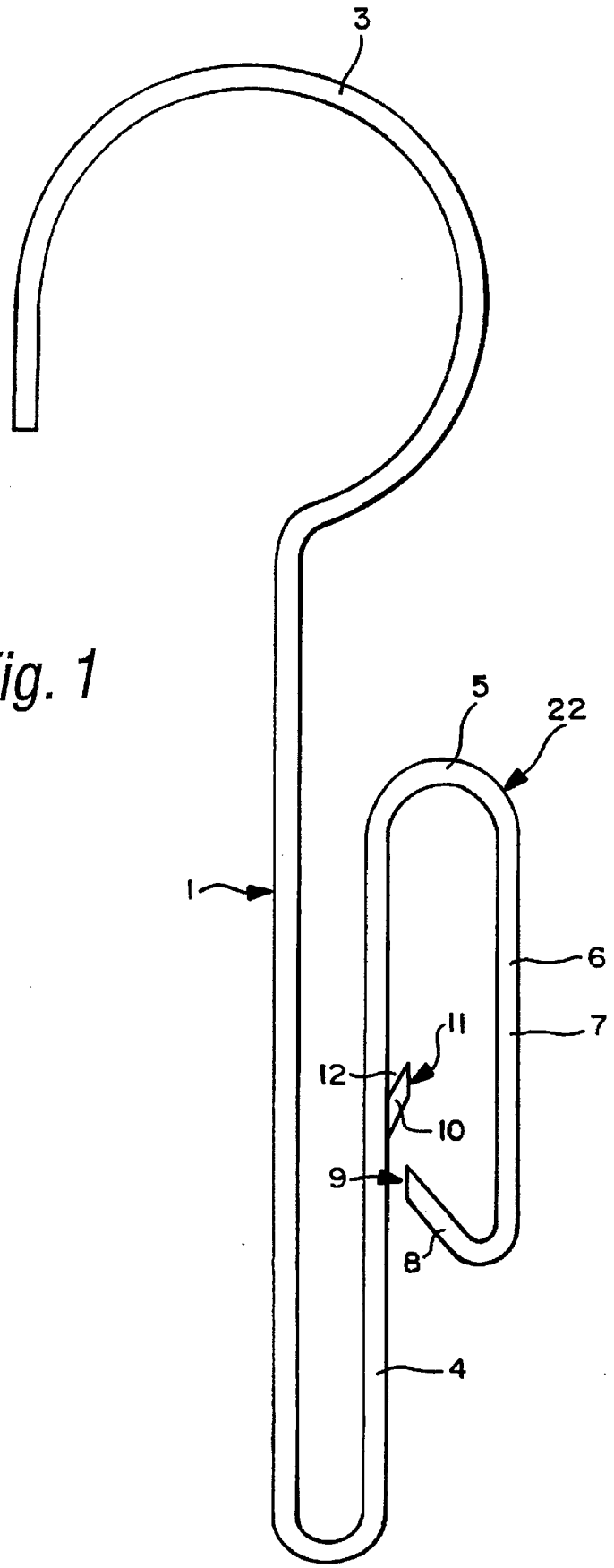

The holder shown in the drawing comprises a carrier member designated by the general reference numeral 1, and a container engagement member designated by the general reference numeral 2. At the upper end 3, as shown on the drawing, the carrier member 1 is bent in an arced shape so that the holder is suitable for being suspended from the belt of a user or on a ladder. Via a 180° bend, the opposite end of the carrier member 1 is formed integrally with the container engagement member 2, which comprises a supporting part 4 extending substantially in parallel with the carrier member 1 and being adapted to bear against the external side of a container being carried by the holder. An arc-shaped connecting portion 5 merges into a hook 6 consisting of a shank 7, which is approximately parallel with, but inclines slightly towards the supporting part 4, and ends in a flap 8 which is bent back at an angle of about 100° and extends towards the supporting part 4. This flap has an end 9 which is obliquely cut off substantially in parallel with the adjacent side of the supporting part 4.

Between the free end 9 of the hook and the connecting portion 5, the supporting part 4 has a retaining strip 10 which projects in the direction of the hook. This retaining strip 10 is produced by stamping out a flap in the material of the supporting part 4. It serves to carry a container by engagement below a downward edge on an external collar, if any, while the hook 6 serves to carry a container by catching below an internal collar of the container. The retaining strip 10 has a free end which is obliquely cut off substantially in parallel with the adjacent side of the supporting part 4.

The hook 6 and the retaining strip 10 are adapted by suitable dimensioning and mutual arrangement so that they cooperate to retain the container in question.

The preferred embodiment of the holder shown is suitably manufactured from a flat rod-shaped iron material having the dimensions of approximately 3×10×400 mm. At the suspension end 3 of the carrier member 1, it is formed with an arced shape forming a semi-circle of a diameter of 60 mm. The portion from this arc-shaped part 3 to the 180° bend merging into the supporting part 4 of the container engagement member 2 is about 130 mm long. The supporting part 4 is about 55 mm long, and the retaining strip 10 is stamped out at a distance of about 25 mm from the arc-shaped connecting portion 5. The retaining strip is formed by stumping out of a piece of about 5×10 mm and forms an angle of about 45° with the supporting part, the strip forming depression 12 facing the connecting portion 5. The shank of the hook 6 is about 30 mm long, and the bent-back flap of the hook is about 10 mm long. The connecting portion 5 has a length so that its ends are about 30 mm apart. The result of the stated dimensions is that a container with en external collar will always be pressed towards the supporting part 4 and thus be secured in stable engagement with the retaining strip 10. Correspondingly, the retaining strip 10 ensures that the container having an internal collar is retained in engagement with the hook 6.

At use in connection with containers having an external collar, the holder is arranged with the engagement member 2 above the upper edge of the container, and the supporting part extending from here downwards along the exterior side of the container, whereupon the holder is pressed downwards, until the edge of the container has passed between the hook 6 of the container engagement member 2 and the supporting part 4, and the lower edge of the collar in question is located at a level above the retaining strip 10. Then the holder is again pulled upwards, until the free edge of the external collar has passed into the depression 12. The holder with container is then ready for suspension in the carrier member 1.

At use in connection with containers having an internal collar, the holder is laid over the container with the supporting part 4 resting on the upper edge of the container and the engagement part 2 projecting downwards towards the container bottom, while the carrier member 1 has a substantially radial position in relation to the container. Then the holder is displaced radially outwards, until the free end 9 of the hook 6 has passed below the internal collar of the container. Then the holder is turned up to a position in which the carrier member 1 extends in parallel with the exterior wall of the container. The container is now ready to be transported and possibly suspended by means of the holder.

The length of the supporting part 4 in a direction away from the hook 6 determines the angle at which the container with an external collar is carried on the holder. Consequently, this length may be adjusted according to desire. At a suitable distance between the carrier member 1 and the supporting part 4 of the container engagement part 2, objects, such as paint pots with handles, wires, and the like, may suitably be suspended therebetween.

The present invention has been described with reference to a preferred embodiment. Many amendments may be made without thereby deviating from the concept of the invention. The holder may, for example, be manufactured from several interconnected parts, and the retaining strip be a stud welded or otherwise fastened onto the supporting part.

I claim:

1. A holder for a first container having an internal collar or a second container having an external collar, comprising:

a carrier member having an upper arched end for suspending the holder in a substantially downward extending position, said carrier member having a lower end;

a container engagement member connected with said carrier member for engaging the first or second container, said container engagement member including a hook having a depending shank, said hook being connected adjacent an upper end thereof and via a connecting portion with a supporting part for supporting an exterior side of a container, said supporting part rising from said lower end of said carrier member between said carrier member and said shank and extending a distance from said shank at least equal to or greater than the width of the internal and external collars of the first and second containers, respectively, said shank having a flap at its said lower end thereof terminating in a free end facing said supporting part for engaging the internal collar of the first container, said supporting part having between said free end of the flap and said connecting portion, a retaining strip facing said shank for engaging the external collar of the second container.

2. A holder according to claim 1 integrally formed from a bent flat rod, said retaining strip including a flap stamped out from said rod.

3. A holder according to claim 2 wherein said retaining strip forms an acute angle with said support part on the side facing the connecting portion.

4. A holder according to claim 3 wherein said free end of said retaining strip has an end face substantially parallel to an adjacent side of said supporting part.

5. A holder according to claim 2 wherein the free end of said hook has an end face substantially parallel to an adjacent side of said supporting part.

6. A holder according to claim 2 wherein said free end of said retaining strip has an end face substantially parallel to an adjacent side of said supporting part.

7. A holder according to claim 1 wherein said retaining strip forms an acute angle with said support part on the side facing the connecting portion.

8. A holder according to claim 7 wherein the free end of said hook has an end face substantially parallel to an adjacent side of said supporting part.

9. A holder according to claim 7 wherein said free end of said retaining strip has an end face substantially parallel to an adjacent side of said supporting part.

10. A holder according to claim 1 wherein the free end of said hook has an end face substantially parallel to an adjacent side of said supporting part.

11. A holder according to claim 10 wherein said free end of said retaining strip has an end face substantially parallel to an adjacent side of said supporting part.

12. A holder according to claim 1 wherein said free end of said retaining strip has an end face substantially parallel to an adjacent side of said supporting part.

* * * * *